US007044902B2

(12) United States Patent
d'Agrella et al.

(10) Patent No.: US 7,044,902 B2
(45) Date of Patent: May 16, 2006

(54) PRINTING PRESS FOLDER AND FOLDER COMPONENTS

(75) Inventors: Ingermar S. d'Agrella, Pewaukee, WI (US); Dennis Sopik, New Berlin, WI (US); Richard J. Fox, Menomonee Falls, WI (US); Jeffrey Karch, West Bend, WI (US)

(73) Assignee: Quad/Tech, Inc., Sussex, WI (US)

( * ) Notice: Subject to any disclaimer, the term of this patent is extended or adjusted under 35 U.S.C. 154(b) by 6 days.

(21) Appl. No.: 10/731,838

(22) Filed: Dec. 9, 2003

(65) Prior Publication Data

US 2005/0124481 A1 Jun. 9, 2005

(51) Int. Cl.
*B31B 1/16* (2006.01)

(52) U.S. Cl. ..... 493/224; 493/241; 493/324; 493/345; 83/102; 83/105; 83/110; 271/176; 271/198; 271/298; 271/303; 271/315

(58) Field of Classification Search ..... 493/224, 493/241, 324, 345; 83/102, 105, 106, 110; 271/176, 198, 271, 272, 298, 303, 315
See application file for complete search history.

(56) References Cited

U.S. PATENT DOCUMENTS 4,381,705 A 5/1983 Roes et al.
4,569,672 A 2/1986 Marion et al.
4,604,083 A 8/1986 Barny et al.
4,616,815 A 10/1986 Vijuk
4,667,953 A 5/1987 Hirakawa et al.
4,729,282 A 3/1988 Kasdorf
4,948,112 A * 8/1990 Sato et al. ..... 270/60
5,080,338 A * 1/1992 Belanger et al. ..... 270/6
5,112,033 A * 5/1992 Breton ..... 270/47
5,117,753 A 6/1992 Mamberer
5,162,036 A 11/1992 Peter et al.
5,207,412 A 5/1993 Coons, Jr. et al.
5,217,425 A 6/1993 Cantrell
5,309,834 A 5/1994 Koch
5,358,464 A 10/1994 Funk et al.
5,437,442 A 8/1995 Petersen
5,439,206 A 8/1995 Raasch et al.
5,562,195 A 10/1996 Isaacs
5,653,428 A * 8/1997 Dufour et al. ..... 270/6
5,702,100 A * 12/1997 Novick et al. ..... 271/302
6,131,053 A 10/2000 Nyffenegger et al.
6,199,860 B1 3/2001 d'Agrella et al.

(Continued)

FOREIGN PATENT DOCUMENTS

GB 2 333 768 8/1999

*Primary Examiner*—Stephen F. Gerrity
*Assistant Examiner*—Hemant M. Desai
(74) *Attorney, Agent, or Firm*—Michael Best & Friedrich LLP

(57) ABSTRACT

A folder operable to cut a printed web received from a printing press. The folder includes a cutting section having cutting cylinders that cut the web into individual printed products, and a cutting motor that is operable to drive the cutting cylinders. A delivery assembly of the folder includes delivery belts that are operable to guide the individual printed products through the folder, and at least one delivery motor is operable to drive the delivery belts. The folder also includes a diverting assembly that diverts individual printed products to one of a plurality of collation paths, and a diverting motor that is operable to drive the diverting assembly. The cutting motor, the delivery motor, and the diverting motor are operable independently of one another.

13 Claims, 1 Drawing Sheet

U.S. PATENT DOCUMENTS 6,254,093 B1 * 7/2001 d'Agrella et al. ..... 271/279
6,360,640 B1 * 3/2002 Cote ..... 83/287
6,394,445 B1 * 5/2002 d'Agrella et al. ..... 271/182
6,572,097 B1 * 6/2003 d'Agrella et al. ..... 271/182
6,752,751 B1 * 6/2004 Jackson et al. ..... 493/428
6,776,750 B1 * 8/2004 Stieler et al. ..... 493/424

* cited by examiner 10
18
14
22
26
M1
160
28
36
34
M2
30
62
38
42
48
148
46
M5
50
54
M3
66
82
78
70
76
74
86
98
M4
58
90
112
94
106
120
156
136
116
102
152
132
M6
110
144
140
128
130
M7
124
M9
M8

PRINTING PRESS FOLDER AND FOLDER COMPONENTS

FIELD OF THE INVENTION

The invention relates to a folder for a printing press.

BACKGROUND

One type of printing press prints images upon a web of material, such as paper. Many such printing presses include impression cylinders that apply ink and other pigments to the web, thereby transferring at least a portion of an image onto the web. Impression cylinders come in a variety of sizes such that for a single rotation of the impression cylinder, a certain number of pages are printed on the web. Typical impression cylinders yield between one and four pages per revolution.

Gravure printing presses are configured such that the circumference of the impression cylinder can be changed. By changing the impression cylinder circumference, the length of the pages printed by the gravure press can also be changed. Gravure presses therefore provide added flexibility with respect to the size of the finished printed product that the printing press can produce.

Folder devices are also known that receive the printed web from the printing press and cut the web into individual printed products such as, for example, signatures. Many folder devices are also operable to divert the individual signatures to different collation paths as required for a given printing job. Some known folder devices are drivingly coupled to the printing press such that the operating speed of the folder device corresponds to the operating speed of the printing press. Changes to the printing press, such as changes to the impression cylinder to vary the number of pages per cylinder revolution, and/or to vary the length of the printed page, require corresponding changes to the folder device. Various types of mechanical gearing devices have been utilized to attain multiple drive ratios between the printing press and certain folder components, in an effort to accommodate such changes to the printing press.

SUMMARY OF THE INVENTION

The present invention provides a folder that is operable to cut a printed web into individual printed products. In some aspects, the folder generally includes at least one infeed roller and a first motor that is operable to drive the at least one infeed roller at a first speed. The folder includes a pair of cutting cylinders positioned downstream of the at least one infeed roller, and a second motor that is operable to drive the cutting cylinders at a second speed that is independently variable from the first speed. The folder further includes a diverter mechanism positioned downstream of the cutting cylinders, and a third motor that is operable to drive the diverter mechanism at a third speed that is independently variable from the first and second speeds.

Other features of the invention will become apparent to those skilled in the art upon review of the following detailed description, claims, and drawings.

Figure 1:
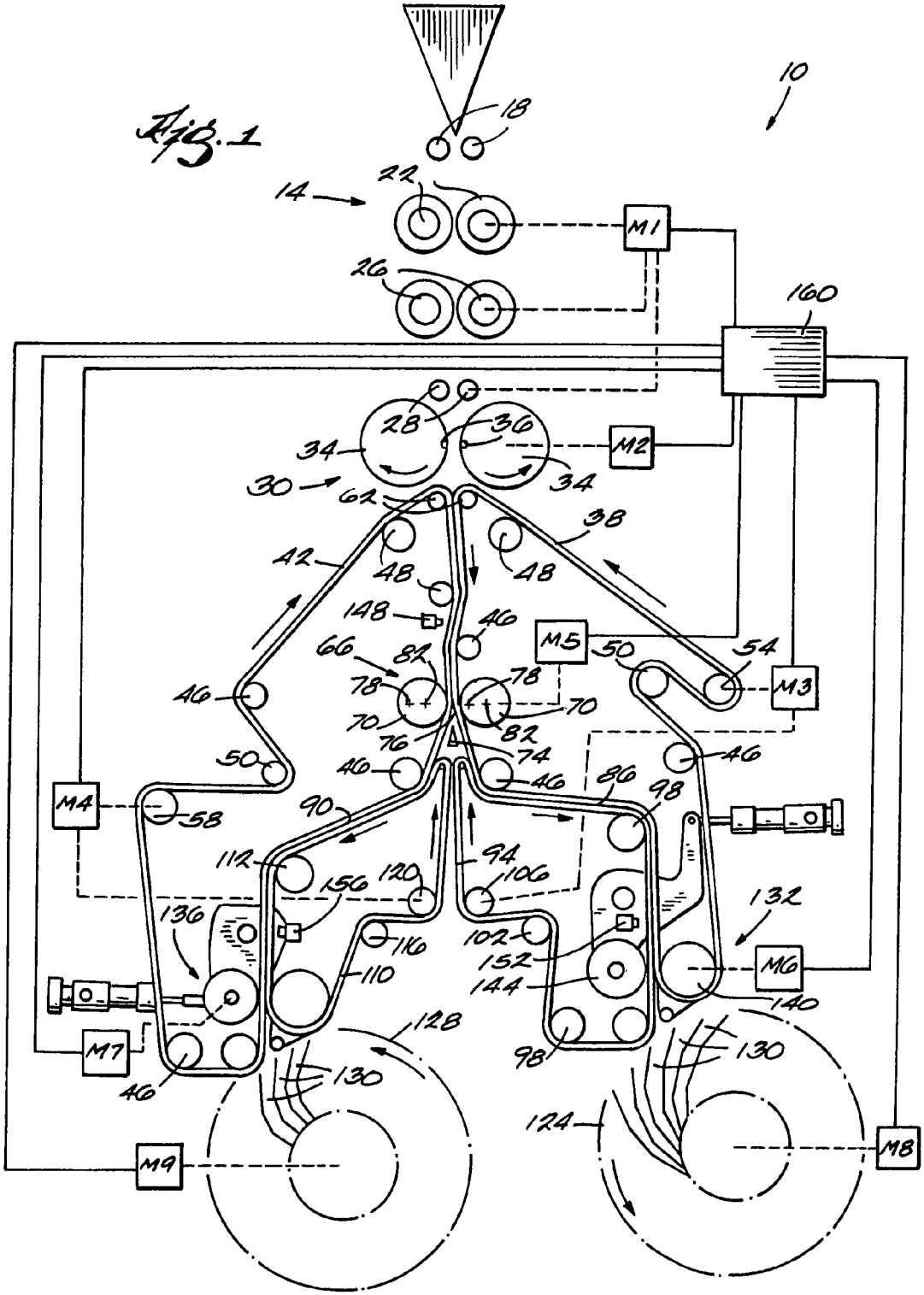
FIG. 1 is a schematic illustration of a printing press folder device.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION

FIG. 1 illustrates a folder assembly 10 embodying the invention. The folder assembly 10 is configured to be positioned downstream of a printing press (not shown) and to receive a web of printed product therefrom. The web of printed product travels into the folder assembly at a web travelling speed. The printing press includes a lineshaft (not shown) that rotates at a speed corresponding to the rotational speed of the print cylinder. The lineshaft speed and the circumference of the print cylinder can be therefore be combined to calculate the web travelling speed. The folder assembly 10 is configured to cut the web into individual printed products such as, for example, signatures, and to selectively divert the individual printed products to downstream processing equipment such as a conveyor. Hereafter, the invention will be described with respect to signatures, however it should be noted that other types and configurations of printed products are also usable with this invention.

The folder assembly 10 includes an infeed section 14 for receiving and conditioning the web prior to cutting the web into individual signatures. The infeed section 14 includes a pair of forming rollers 18 that guide the web into the folder assembly 10. Downstream of the forming rollers 18 are two pairs of nip rollers 22, 26 that tension the web as the web travels through the infeed section 14. Downstream of the nip rollers 22, 26 is a pair of conditioning rollers 28 that deform the web as the web exits the infeed section 14. A first infeed motor M1 is operable at a first rotational speed to rotatably drive the nip rollers 22, 26, and the conditioning rollers 28. Although the motor M1 operates at a single, although variable speed, the actual rotational velocities (in rpm, for example) of the rollers can vary between pairs of rollers as necessary depending upon the respective diameters of the rollers of an individual pair. The rollers of the infeed section 14 are generally driven at velocities that correspond to the web travelling speed as determined by the lineshaft speed and the print cylinder diameter, and may be driven slightly faster than the web travelling speed to properly tension the web. Various types of gear boxes, drive couplings, and the like can be utilized between the first motor M1 and the individual pairs of rollers 22, 26, 28 to drive the individual pairs of rollers at different rotational velocities, if necessary.

Downstream of the infeed section 14 is a cutting section 30. The cutting section 30 includes a pair of cutting cylinders 34. The cutting cylinders 34 include one or more cutting blades 36 that cut the web into individual signatures. The cutting blades 36 can be configured and arranged such that one or more individual signatures are cut from the web with each revolution of the cutting cylinders 34. In the illustrated embodiment, one signature is cut for each revolution of the cutting cylinders 34.

The cutting cylinders 34 are independently driven by a second motor M2 that operates at a second rotational speed. The second motor M2 rotatably drives the cutting cylinders 34 at a rotational velocity that corresponds to the lineshaft speed and the number of pages printed on the web for each revolution of the print cylinder. Thus, for a print cylinder that prints two pages per revolution, the illustrated cutting cylinders 34, which cut one signature per revolution, would be driven at twice the lineshaft speed. If a different print cylinder that prints only one page per revolution was utilized, the cutting cylinders 34 would be driven at a speed equal to the lineshaft speed. Because the cutting cylinders 34 are driven at a speed that is based substantially only upon the number of signatures printed by the print cylinder and the lineshaft speed, print cylinders having different or variable diameters can be utilized without necessitating changes to the control relationship between the second motor M2 and the lineshaft.

Downstream of the cutting cylinders 34, the signatures enter a nip between a first delivery belt 38 and a second delivery belt 42. The delivery belts 38, 42 travel in endless loops through the folder assembly 10 and are guided by a series of idler rollers 46 and tensioning rollers 50. A first drive roller 54 drives the first delivery belt 38, and a second driver roller 58 drives the second delivery belt 42. The first drive roller 54 is rotatably driven by a third motor M3, and the second drive roller 58 is rotatably driven by a fourth motor M4. The third and fourth motors M3, M4 are operable at a third and a fourth rotational speed, respectively.

A pair of nip rollers 62 are positioned downstream of the cutting cylinders 34 and guide the delivery belts 38, 42 into face to face relation, thereby forming the nip. After an individual signature is cut from the web by the cutting cylinders 34, the signature is received by the nip and carried downstream between the delivery belts 38, 42. The speeds of the third and fourth motors M3, M4, which are substantially the same during folder operation, are preferably selected such that the first and second drive rollers 54, 58 drive the delivery belts 38, 42 at a belt velocity that is greater than the travelling speed of the web. In this regard, signatures are accelerated as they exit the cutting cylinders 34 and a gap is established between sequential signatures being carried by the delivery belts 38, 42. The difference between the belt velocity and the web travelling speed is referred to as the belt overspeed.

The speeds of the third and fourth motors M3, M4 are independently variable from the speeds of the first and second motors M1, M2, and from the web travelling speed. In this regard, the size of the gap that is established between sequential signatures carried by the delivery belts 38, 42 can be changed by increasing or decreasing the speeds of the third and fourth motors M3, M4 with respect to the web travelling speed.

Downstream of the nip rollers 62, the signatures are carried by the delivery belts 38, 42 to a diverter mechanism 66. The illustrated diverter mechanism 66 includes a pair of diverter rolls 70 and a diverter wedge 74 downstream of the diverter rolls 70. The delivery belts 38, 42 engage and are at least partially guided by the diverter rolls 70. The delivery belts 38, 42 diverge from one another downstream of the diverter rolls 70, and cooperate to define a diverting nip 76 between the diverter rolls 70.

In the illustrated construction, each diverter roll 70 is eccentrically mounted for oscillatory motion about a rotational axis 78. More particularly, each diverter roll 70 includes a central axis 82, and the rotational axis 78 is offset from the central axis 82. The diverter mechanism 66 is driven by a fifth motor M5 to rotate the diverter rolls 70 about their respective rotational axes 78. The fifth motor M5 is operable at a fifth speed that is independently variable with respect to the first, second, third, and fourth speeds, and with respect to the web travelling speed. The operating speed of the fifth motor M5 can be selected based upon the diverter operating mode (discussed below), the web travelling speed, the belt overspeed, and the length of signatures being cut, as well as additional factors.

Each diverter roll 70 includes an outer surface that is freely rotatable with respect to the central portion of the roll. In this regard, the delivery belts 38, 42 can travel at substantially any speed over the diverter rolls 70, even if the diverter rolls 70 are rotating relatively slowly or not at all. During operation, eccentric rotation of the diverter rolls 70 about their rotational axes 78 moves the diverter nip 76 back and forth over the diverter wedge 74. When the diverter nip 76 is on a first side of the diverter wedge 74, signatures passing between the diverter rolls 70 are guided along the first side of the diverter wedge 74 to a first collation path 86. When the diverter nip 76 is on a second, opposite side of the diverter wedge 74, signatures passing between the diverter rolls 70 are guided along the second side of the diverter wedge 74 to a second collation path 90.

In some modes of operation, the speed of the fifth motor M5 is selected such that the diverter rolls 70 oscillate between the first and second sides of the diverter wedge 74 in a manner that diverts sequential signatures altematingly to the first and second collation paths 86, 90. In other modes of operation, the speed of the fifth motor M5 can be selected to divert two or more signatures to the first collation path 86 and two or more subsequent signatures to the second collation path 90. In still further modes of operation, the fifth motor M5 may not be operated at all, such that the diverter rolls 70 are substantially stationary and all signatures carried by the delivery belts 38, 42 are diverted to a single one of the collation paths 86, 90.

It should be appreciated that other types of diverting mechanisms can be used with the folder assembly 10 of the present invention. Many other types and styles of diverting mechanisms are well known to those skilled in the art. Some diverting mechanisms include a substantially stationary diverter nip and an oscillating diverter wedge. Still other diverting mechanisms include diverter rollers having raised cam surfaces that urge signatures toward either side of a diverter wedge. It should be readily apparent to one of ordinary skill in the art that substantially any type of diverting mechanism can be used in accordance with the teachings of the present invention. Two types of suitable diverter mechanisms are described in commonly assigned U.S. Pat. No. 6,302,292, issued Oct. 16, 2002, and U.S. Pat. No. 4,729,282, issued Mar. 8, 1988, which are hereby incorporated by reference.

Downstream of the diverter wedge 74, a first collator belt 94 cooperates with the first delivery belt 38 to define the first collation path 86. The first collator belt 94 travels in an endless loop through the folder assembly 10 and lies in substantially face to face relation with the first delivery belt 38 downstream of the diverter wedge 74. The first collator belt 94 is supported and guided by idler rollers 98 and a tensioning roller 102. A drive roller 106 drives the first collator belt 94. The drive roller 106 is rotatably driven by the third motor M3 such that the belt velocities of the first delivery belt 38 and the first collator belt 94 are substantially equal.

Similarly, a second collator belt 110 cooperates with the second delivery belt 42 to define the second collation path 90. The second collator belt 110 travels in and endless loop through the folder assembly 10 and lies in substantially face to face relation with the second delivery belt 42. Idler roller 112 and tensioning roller 116 support and guide the second collator belt 110. The second collator belt 110 is driven by a drive roller 120. The drive roller 120 is driven by the fourth motor M4 such that the belt velocities of the second delivery belt 42 and the second collator belt 110 are substantially equal.

Each collation path 86, 90 guides signatures to a respective delivery bucket 124, 128. The delivery buckets 124, 128 define delivery slots 130 that receive the signatures delivered along each collation path 86, 90 and deposit the signatures onto output conveyors (not shown). The output conveyors then deliver the signatures to additional downstream processing equipment. With respect to the first collation path 86, prior to being deposited into the delivery buckets 124, the signatures are released from between the first delivery belt 38 and the first collation belt 94 and pass through a slow down device 132. Similarly, signatures delivered along the second collation path 90 pass through a substantially identical slow down device 136. Because the construction and operation of the slow down devices 132, 136 are substantially the same, only one slow down device is described further below. The illustrated slow down device is also described in commonly assigned U.S. Pat. No. 6,394,445, issued May 28, 2002, which is hereby incorporated by reference.

In the illustrated construction, the slow down device 132 includes a pair of snubber cams 140, 144 having raised cam surfaces that intermittently extend into the signature delivery path and grip the trailing edge of each signature. The snubber cams 140, 144 are rotatably driven by a sixth motor M6 at a rotational velocity that is less than the belt velocity such that, when the snubber cams 140, 144 grip the trailing edge of a signature being carried by the belts 38, 94, the velocity of the signature is reduced before the signature is deposited in the delivery bucket 124. The operating speed of the motor M6 is independently variable from the other motors such that the magnitude of the reduction in signature velocity can be varied. In some operating modes, the sixth motor M6 may not be operated at all and the raised cam surfaces can be positioned out of the signature delivery path, such that there is substantially no reduction in signature velocity.

It should be readily apparent to one of ordinary skill in the art that other types of known slow down devices, such those including various types of brushes, grippers, air blowing devices, and the like, can be used in accordance with the teachings of the present invention. In addition to the sixth motor M6, which independently drives the slow down device 132, a seventh motor M7 is operable to independently drive the slow down device 136, it being understood that the operation and construction of the slow down device 136 is similar to that of the slow down device 132.

Eighth and ninth motors M8, M9 are operable to independently drive the delivery buckets 124, 128. Each motor M8, M9 is operable at a rotational speed that can be changed depending upon, among other things, the web travelling speed, the belt overspeed, the operating mode of the diverter mechanism 66, and the operating mode of the slow down devices 132, 136. In addition, the motors M8, M9 can be operated to change the relative rotational position or phasing of the delivery buckets 124, 128 with respect to the signatures, if necessary. A description of a suitable delivery bucket assembly can be found in commonly assigned U.S. Pat. No. 6,199,860, issued Mar. 13, 2001, which is hereby incorporated by reference.

It should be appreciated that each motor is operatively coupled to its respective roller or device by a drive system. The drive systems can take substantially any form, and can include gears, pulleys, chains, sprockets, belts and the like. Although it may be advantageous to operatively couple the motors to their respective rollers and devices for operation at a single drive ratio, gearboxes and the like can be provided to change the drive ratios between the various motors, rollers, and devices if desired. In addition, the specific arrangement of the belts and pulleys illustrated in the drawings can be changed depending upon, among other things, the machinery (e.g. the printing press and output conveyors) with which the folder assembly 10 is to be utilized.

It should also be appreciated that the folder assembly 10 includes a frame that rotatably supports the various rollers, cylinders, and devices discussed above. The sections of the folder assembly 10, such as the infeed section 14, the cutting section 30, the diverter mechanism 66, the slow down mechanisms 132, 136, and the delivery buckets 124, 128, are generally non-moveable with respect to one another. Specifically, a distance between the infeed section 14 and the cutting section 30, and a distance between the cutting section 30 and the diverting mechanism 66, are substantially fixed. Of course certain components, such as the tensioning rollers 50, 102, 116 for example, are pivotally mounted to the frame to maintain sufficient tension on the delivery belts 38, 42 and the collation belts 94, 110, as is well known in the art.

The illustrated folder assembly 10 also includes a system of sensors that sense the positions of the signatures travelling through the folder assembly 10. Specifically, a first sensor 148 is positioned between the cutting rollers 34 and the diverter mechanism 66. The first sensor 148 is operable to sense, among other things, the size of the gap that is formed between sequential signatures when the signatures are received between the first and second collator belts 38, 42. Second and third sensors 152, 156 are positioned between the diverter mechanism 66 and the first and second slow-down devices 132, 136, respectively. The second and third sensors 152, 156 are operable to sense, among other things, the spacing between sequential signatures travelling along the first and second collation paths 86, 90 respectively. The sensors 148, 152, 156 can be optical sensors that directly detect the presence of the signature, or can be other types of sensors that directly or indirectly detect the position of signatures in the folder assembly 10. It should be appreciated that the sensors 148, 152, 156 can be positioned elsewhere within the folder assembly 10, and that more or fewer sensors can be used as desired.

Each motor M1–M9 and each sensor 148, 152, 156 electronically communicates with a control system 160. The control system 160, the sensors 148, 152, 156, and the motors M1–M9 form a closed-loop system for operative control of the folder assembly 10. In the illustrated construction, each motor M1–M9 is a servo motor and includes an encoder device (not shown) that sends a signal to the controller to indicate how fast each motor is rotating. It should be appreciated that other types of motors such as stepper motors and the like can also be utilized. The control system 160 is suitably programmed with information relating to the drive ratio between each motor M1–M9 and its associated rollers and/or devices such that the control system 160 is able to calculate the rotational velocities of the various rollers and devices from the motor speed. In addition, the control system 160 is suitably programmed with information relating to the sizes (e.g. the diameters) of the various rollers such that belt velocities and the like can also be calculated. The control system 160 communicates with an encoder or similar device that is operable to detect the lineshaft speed of the printing press. It should be appreciated that information relating to the web travelling speed is derived from the indicated speed of the lineshaft, and that the various operating speeds of the motors M1–M9 can vary in response to changes in the lineshaft speed.

In operation, information relating to the speed, size, and operating characteristics of the printing press is programmed into the control system 160. One type of gravure printing press, presented herein for exemplary purposes only, is able to vary a printed signature length by changing the diameter of a print cylinder. Specifically, for a signature length of approximately 10.00", the print cylinder diameter is approximately 12.73", and for a signature length of approximately 11.50", the print cylinder diameter is approximately 14.32". Thus, for a given rotational speed of the print cylinder (in rpm, for example), the web travelling speed for the 10.00" signature is slower than the web travelling speed of the 11.50" signature. As such, regardless of the web travelling speed, the ratio between the print cylinder speed and the lineshaft speed generally remains substantially constant. With these factors in mind, the printed signature length and the print cylinder diameter are input into the control system 160, such that the control system 160 is able to calculate the web travelling speed.

Once the web travelling speed is calculated a signal is sent to the infeed motor M1 to drive the rollers 22, 26, and 28 at a rotational velocity that corresponds to the web travelling speed. The control system 160 utilizes the web travelling speed and the known diameters of the rollers 22, 26, and 28 to calculate the required infeed motor M1 rotational speed. In some constructions, the conditioning rollers 28 have a diameter that is different than the diameters of the nip rollers 22, 26. As such, the drive assembly between the infeed motor M1 and the conditioning rollers 28 is configured to drive the conditioning rollers 28 at a different rotational velocity than the nip rollers 22, 26 and the guide rollers 26. Also, as discussed above, the nip rollers 22, 26 and the conditioning rollers 28 may be driven at a rotational velocity that is slightly greater than the web travelling speed to maintain sufficient tension on the printed web.

The control system 160 sends signals to the motor M2 such that the cutting cylinders 34 are drivingly rotated at a rotational velocity that corresponds to the lineshaft speed and the number of pages printed by the print cylinder. As mentioned above, the speed of the cutting cylinders 34 is independent of the print cylinder diameter and the web travelling speed. Thus for a constant lineshaft speed the rotational velocity of the cutting cylinders will also remain constant, regardless of the size of the print cylinder. This is because for a smaller print cylinder that prints a shorter signature (e.g. 10.00"), the web travelling speed is slower than for a larger print cylinder that prints a longer signature (e.g. 11.50"). The faster web travelling speed results in an increase in the length of signatures cut by the cutting cylinders 34, without changing the rotational velocity of the cutting cylinders 34.

The control system 160 sends signals to the motors M3, M4 to drive the delivery belts 38, 42. The delivery belts 38, 42 are driven at a belt velocity that is calculated based upon the desired belt overspeed and the web travelling speed. Generally, the larger the desired gap between sequential signatures, the faster the belts will be driven with respect to the web travelling speed.

The control system 160 sends signals to the motor M5 to drive the signature diverter mechanism 66. The rotational speed of the motor M5, and therefore the operating characteristics of the diverter mechanism 66, are a function of the web travelling speed, the belt overspeed, the signature length, and the desired diverting characteristics. In general, the faster the signatures are travelling through the folder, the faster the diverter mechanism 66 must be driven. In addition, shorter signature lengths (e.g. 10.00") will generally also require an increase in the speed of the diverter mechanism 66 compared to longer signature lengths (e.g. 11.50"). As discussed above, the signature diverting mechanism 66 can also be operated to divert more than one signature to one of the diverter paths 86, 90 at a time, or can be substantially deactivated to divert signatures to a single diverter path 86, 90, if so desired. For example, if maintenance is required on one of the slow down mechanisms 132 136, or on one of the delivery buckets 124, 128, all the signatures can be diverted to the other slow down mechanism or delivery bucket, thereby allowing operation to continue while the maintenance is performed.

Operation of the motor M5 can also be adjusted based upon signals received from the sensor 148. As discussed above, the sensor 148 senses the relative positions of the signatures travelling toward the diverter mechanism 66. The control system 160 can be configured to advance or retard the speed of the motor M5 in response to small changes in the gaps between sequential signatures as sensed by the sensor 148. While the sensor 148 may improve folder performance for some applications, it should be appreciated that the sensor 148 is not required for folder 10 operation.

The control system 160 sends signals to the motors M6, M7 to drive the slow down devices 132, 136, respectively, based upon the web travelling speed, the belt overspeed, the operating mode of the diverter mechanism 66, and the desired amount of signature speed reduction. As discussed above, the slow down devices 132, 136 are generally driven slower than the travelling speed of the signatures such that the signatures are slowed down before being deposited into the delivery buckets 124, 128. In general, driving the slow down devices 132, 136 at a faster speed will reduce the amount of signature speed reduction. The slow down devices 132, 136 can also be deactivated such that there is substantially no reduction in signature speed, if desired.

The control system 160 sends signals to the motors M8, M9 to drive the delivery buckets 124, 128, respectively, based upon the web travelling speed, the belt overspeed, the operating mode of the diverter mechanism 66, and the amount of signature speed reduction provided by the slow down devices 132, 136. The delivery buckets 124, 128 can be rotated such that a signature is received in each delivery slot 130, or such that signatures are received between only selected delivery slots 130 (e.g. every second or third slot, without limitation). The motors M8, M9 can also be operated to adjust the relative positions or phasing of the delivery buckets 124, 128, as discussed above.

Operation of the motors M6–M9 can be adjusted based upon signals received from the sensors 152, 156. As discussed above, the sensors 152, 156 sense the relative positions of the signatures travelling along the first and second collation paths 86, 90. If the sensor 152 senses irregularities in the gap between sequential signatures travelling along the first collation path 86, the control system 160 can be configured to advance or retard the speeds of the motors M6 and M8 accordingly. Similarly, the speeds of the motors M7 and M9 can be advanced or retarded in response to signature gap irregularities sensed by the sensor 156. While the sensors 152, 156 may improve folder performance for some applications, it should be appreciated that the sensors 152, 156 are not required for folder assembly 10 operation.

By providing a folder having a plurality of independently driven components as discussed above, changes to signature processing and delivery operations are simplified. Reconfigurations of the folder device such as gearing changes, roller changes, and the like are alleviated or simplified due to the ability of the control system to operate the various motors at different operating speeds as required for different printed product lengths. The folder is particularly well suited for use with printing presses having variable circumference print cylinders, or for applications in which print cylinders of different sizes are frequently interchanged.

Various features of the invention are set forth in the following claims.

The invention claimed is:

1. A folder for a printing press, the folder operable to cut a web into individual printed products, the folder comprising:

at least one infeed roller;

a first motor operable to drive the at least one infeed roller at a first speed;

a pair of cutting cylinders positioned downstream of the infeed roller;

a second motor operable to drive the cutting cylinders at a second speed that is independently variable from the first speed;

a diverter mechanism positioned downstream of the cutting cylinders;

a third motor operable to drive the diverter mechanism at a third speed that is independently variable from the first and second speeds;

first and second delivery belts supported by the frame and circulating in endless loops, the delivery belts lying in substantially face to face relation between the cutting cylinders and the diverter mechanism;

a fourth motor operable to drive the first delivery belt at a fourth speed that is independently variable from the first, second, and third, speeds;

a fifth motor operable to drive the second delivery belt at a fifth speed that is independently variable from the first, second, third, and fourth speeds;

a first slow-down mechanism positioned along a first collation path and independently driven by a sixth motor;

a second slow-down mechanism positioned along a second collation path and independently driven by a seventh motor;

a first delivery bucket positioned downstream of the first slow-down mechanism and independently driven by an eighth motor; and, a second delivery bucket positioned downstream of the second slow-down mechanism and independently driven by a ninth motor.

2. The folder of claim 1 wherein a first distance between the infeed roller and the cutting cylinders, and a second distance between the cutting cylinders and the diverter mechanism are substantially fixed, regardless of the motor speeds.

3. The folder of claim 1 wherein the diverter mechanism includes a diverter wedge.

4. The folder of claim 3 wherein the diverter mechanism includes a diverter nip, and wherein the diverter nip moves with respect to the diverter wedge to guide printed products toward opposite sides of the diverter wedge.

5. The folder of claim 1 further comprising an infeed section including guide rollers that guide the web toward the cutting cylinders.

6. The folder of claim 5 further comprising an infeed motor operable to drive the guide rollers.

7. The folder of claim 1 wherein the fourth and fifth speeds are substantially equal and are variable with respect to the first, second, and third speeds to change a gap between cut printed products carried between the first and second delivery belts.

8. The folder of claim 1 further comprising first and second collator belts circulating in endless loops, the first collator belt lying in substantially face to face relation with the first delivery belt to define the first collation path, and the second collator belt lying in substantially face to face relation with the second delivery belt to define the second collation path, wherein the first collator belt is driven by the fourth motor and the second collator belt is driven by the fifth motor.

9. The folder of claim 8 wherein the third speed is adjustable to zero to thereby divert signatures toward only one of the first and second collation paths.

10. The folder of claim 1 wherein the second speed is variable with respect to the first speed to adjust a cut length of each printed product.

11. The folder of claim 1 further comprising a control system communicating with each motor and operable to vary each speed.

12. The folder of claim 1 further comprising a first printed product sensor positioned between the cutting cylinders and the diverter mechanism and operable to sense a relative position of sequential printed products traveling through the folder, and wherein the third speed is changed in response to the relative position of sequential printed products sensed by the first sensor.

13. The folder of claim 12 further comprising a second printed product sensor positioned between the diverter mechanism and the first slow-down mechanism and operable to sense a relative position of sequential printed products traveling along the first collation path, and a third printed product sensor positioned between the diverter mechanism and the second slow-down mechanism and operable to sense a relative position of sequential printed products traveling along the second collation path, and wherein the sixth and seventh motors operate in response to the relative positions of sequential printed products sensed by the second and third sensors respectively.

* * * * *